US007878180B2

(12) United States Patent
Wang et al.

(10) Patent No.: US 7,878,180 B2
(45) Date of Patent: Feb. 1, 2011

(54) METHOD AND APPARATUS FOR DETERMINING OPERATION ERRORS FOR A HIGH PRESSURE FUEL PUMP

(75) Inventors: Wenbo Wang, Novi, MI (US); Michael J. Lucido, Northville, MI (US); John F. Van Gilder, Webberville, MI (US)

(73) Assignee: GM Global Technology Operations, Inc

( * ) Notice: Subject to any disclaimer, the term of this patent is extended or adjusted under 35 U.S.C. 154(b) by 100 days.

(21) Appl. No.: 12/365,552

(22) Filed: Feb. 4, 2009

(65) Prior Publication Data

US 2010/0192912 A1 Aug. 5, 2010

(51) Int. Cl.
*F02M 55/02* (2006.01)
*F02M 55/00* (2006.01)

(52) U.S. Cl. ..... 123/479

(58) Field of Classification Search ..... 123/479, 123/480, 494, 495, 497, 198 D, 379; 701/29, 701/34, 35, 104, 107
See application file for complete search history.

(56) References Cited

U.S. PATENT DOCUMENTS

| | | | | |
|---|---|---|---|---|
| 4,756,291 | A * | 7/1988 | Cummins et al. | 123/497 |
| 4,827,897 | A * | 5/1989 | Yamada et al. | 123/497 |
| 5,406,922 | A * | 4/1995 | Tuckey | 123/497 |
| 5,687,694 | A * | 11/1997 | Kanno | 123/479 |
| 6,389,901 | B1 * | 5/2002 | Joos et al. | 73/714 |
| 6,609,501 | B2 * | 8/2003 | Doane et al. | 123/458 |
| 2007/0124183 | A1 * | 5/2007 | Williams et al. | 705/7 |

* cited by examiner

*Primary Examiner*—Mahmoud Gimie

(57) ABSTRACT

A control system and method for controlling pump includes a pump control module communicating a drive signal to the high pressure pump and a high pressure pump in communication with the pump control module operating in response to the drive signal. A current sampling module samples a pump current signal to form a sample prior to an end of the drive signal. A current comparison module compares the sample to a threshold that may be a function of pump solenoid resistance, pump solenoid temperature, and/or system voltage, and a fault indication module generates a fault signal in response to comparing.

20 Claims, 4 Drawing Sheets

METHOD AND APPARATUS FOR DETERMINING OPERATION ERRORS FOR A HIGH PRESSURE FUEL PUMP

FIELD

The present disclosure relates to vehicle control systems and more particularly to vehicle control systems for determining when a high pressure fuel pump is not operating properly.

BACKGROUND

Direct injection gasoline engines are currently used by many engine manufacturers. In a direct injection engine, highly pressurized gasoline is injected via a common fuel rail directly into a combustion chamber of each cylinder. This is different than conventional multi-point fuel injection that is injected into an intake tract or cylinder port.

Gasoline-direct injection enables stratified fuel-charged combustion for improved fuel efficiency and reduced emissions at a low load. The stratified fuel charge allows ultra-lean burn and results in high fuel efficiency and high power output. The cooling effect of the injected fuel and the even dispersion of the air-fuel mixture allows for more aggressive ignition timing curves. Ultra lean burn mode is used for light-load running conditions when little or no acceleration is required. Stoichiometric mode is used during moderate load conditions. The fuel is injected during the intake stroke and creates a homogenous fuel-air mixture in the cylinder. A fuel power mode is used for rapid acceleration and heavy loads. The air-fuel mixture in this case is a slightly richer than stoichiometric mode which helps reduce knock.

Direct-injected engines are configured with a high-pressure fuel pump used for pressurizing the injector fuel rail. A pressure sensor is attached to the fuel rail for control feedback. The pressure sensor provides an input to allow the computation of the pressure differential information used to calculate the injector pulse width for delivering fuel to the cylinder. Errors in the measured fuel pressure at the fuel rail result in an error in the mass of the fuel delivered to the individual cylinder.

SUMMARY

The present disclosure provides a method and system by which an error in the operation of the fuel pump may be determined. Determining errors prevents an improper mass of fuel being delivered to the individual cylinder.

In one aspect of the invention, a method of controlling a pump includes communicating a drive signal to the pump, operating the pump in response to the drive signal, prior to an end of the drive signal, sampling a pump current signal to form a sample, and comparing the sample to a threshold and generating a fault signal in response to comparing.

In a further aspect of the invention, a control system for controlling a pump includes a pump control module communicating a drive signal to the pump and the pump in communication with the pump control module operating in response to the drive signal. A current sampling module samples a pump current signal to form a sample prior to an end of the drive signal. A current comparison module compares the sample to a threshold and a fault indication module generates a fault signal in response to comparing.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the disclosure, its application, or uses. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality. As used herein, the term boost refers to an amount of compressed air introduced into an engine by a supplemental forced induction system such as a turbocharger. The term timing refers generally to the point at which fuel is introduced into a cylinder of an engine (fuel injection) is initiated.

Figure 1:
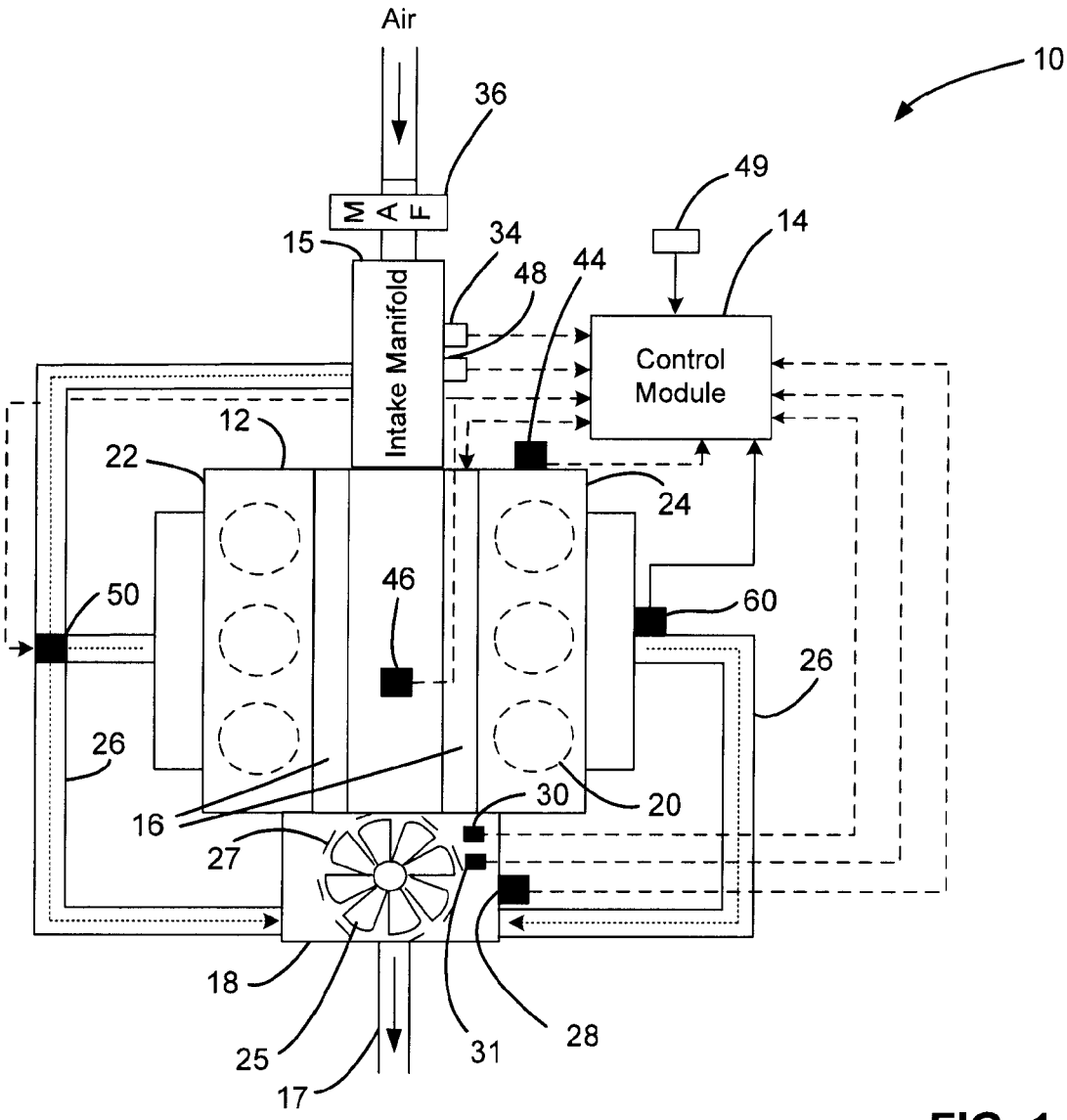
FIG. 1 is a functional block diagram of a control system that adjusts engine timing based on vehicle speed according to some implementations of the present disclosure.

Referring now to FIG. 1, an exemplary engine control system 10 is schematically illustrated in accordance with the present disclosure. The engine control system 10 includes an engine 12 and a control module 14. The engine 12 can further include an intake manifold 15, a fuel injection system 16 having fuel injectors (illustrated in FIG. 2.), an exhaust system 17 and a turbocharger 18. The exemplary engine 12 includes six cylinders 20 configured in adjacent cylinder banks 22, 24 in a V-type layout. Although FIG. 1 depicts six cylinders (N=6), it can be appreciated that the engine 12 may include additional or fewer cylinders 20. For example, engines having 2, 4, 5, 8, 10, 12 and 16 cylinders are contemplated. It is also anticipated that the engine 12 can have an inline-type cylinder configuration. While a gasoline powered internal combustion engine utilizing direct injection is contemplated, the disclosure may also apply to diesel or alternative fuel sources.

During engine operation, air is drawn into the intake manifold 15 by the inlet vacuum created by the engine intake stroke. Air is drawn into the individual cylinders 20 from the intake manifold 15 and is compressed therein. Fuel is injected by the injection system 16, which is described further in FIG. 2. The air/fuel mixture is compressed and the heat of compression and/or electrical energy ignites the air/fuel mixture. Exhaust gas is exhausted from the cylinders 20 through exhaust conduits 26. The exhaust gas drives the turbine blades 25 of the turbocharger 18 which in turn drives compressor blades 25. The compressor blades 25 can deliver additional air (boost) to the intake manifold 15 and into the cylinders 20 for combustion.

The turbocharger 18 can be any suitable turbocharger such as, but not limited to, a variable nozzle turbocharger (VNT). The turbocharger 18 can include a plurality of variable position vanes 27 that regulate the amount of air delivered into the engine 12 based on a signal from the control module 14. More specifically, the vanes 27 are movable between a fully-open position and a fully-closed position. When the vanes 27 are in the fully-closed position, the turbocharger 18 delivers a maximum amount of air into the intake manifold 15 and consequently into the engine 12. When the vanes 27 are in the fully-open position, the turbocharger 18 delivers a minimum amount of air into the engine 12. The amount of delivered air is regulated by selectively positioning the vanes 27 between the fully-open and fully-closed positions.

The turbocharger 18 may include an electronic control vane solenoid 28 that manipulates a flow of hydraulic fluid to a vane actuator (not shown). The vane actuator controls the position of the vanes 27. A vane position sensor 30 generates a vane position signal based on the physical position of the vanes 27. A boost sensor 31 generates a boost signal based on the additional air delivered to the intake manifold 15 by the turbocharger 18. While the turbocharger implemented herein is described as a VNT, it is contemplated that other turbochargers employing different electronic control methods may be employed.

A manifold absolute pressure (MAP) sensor 34 is located on the intake manifold 15 and provides a (MAP) signal based on the pressure in the intake manifold 15. A mass air flow (MAF) sensor 36 is located within an air inlet and provides a mass air flow (MAF) signal based on the mass of air flowing into the intake manifold 15. The control module 14 uses the MAF signal to determine the fuel supplied to the engine 12. An engine speed or RPM sensor 44 such as a crankshaft position sensor provides an engine speed signal. An intake manifold temperature sensor 46 generates an intake air temperature signal. The control module 14 communicates an injector timing signal to the injection system 16. A vehicle speed sensor 49 generates a vehicle speed signal.

The exhaust conduits 26 can include an exhaust recirculation (EGR) valve 50. The EGR valve 50 can recirculate a portion of the exhaust. The controller 14 can control the EGR valve 50 to achieve a desired EGR rate.

The control module 14 controls overall operation of the engine system 10. More specifically, the control module 14 controls engine system operation based on various parameters including, but not limited to, driver input, stability control and the like. The control module 14 can be provided as an Engine Control Module (ECM).

The control module 14 can also regulate operation of the turbocharger 18 by regulating current to the vane solenoid 28. The control module 14 according to an embodiment of the present disclosure can communicate with the vane solenoid 28 to provide an increased flow of air (boost) into the intake manifold 15.

An exhaust gas oxygen sensor 60 may be placed within the exhaust manifold or exhaust conduit to provide a signal corresponding to the amount of oxygen in the exhaust gasses.

Figure 2:
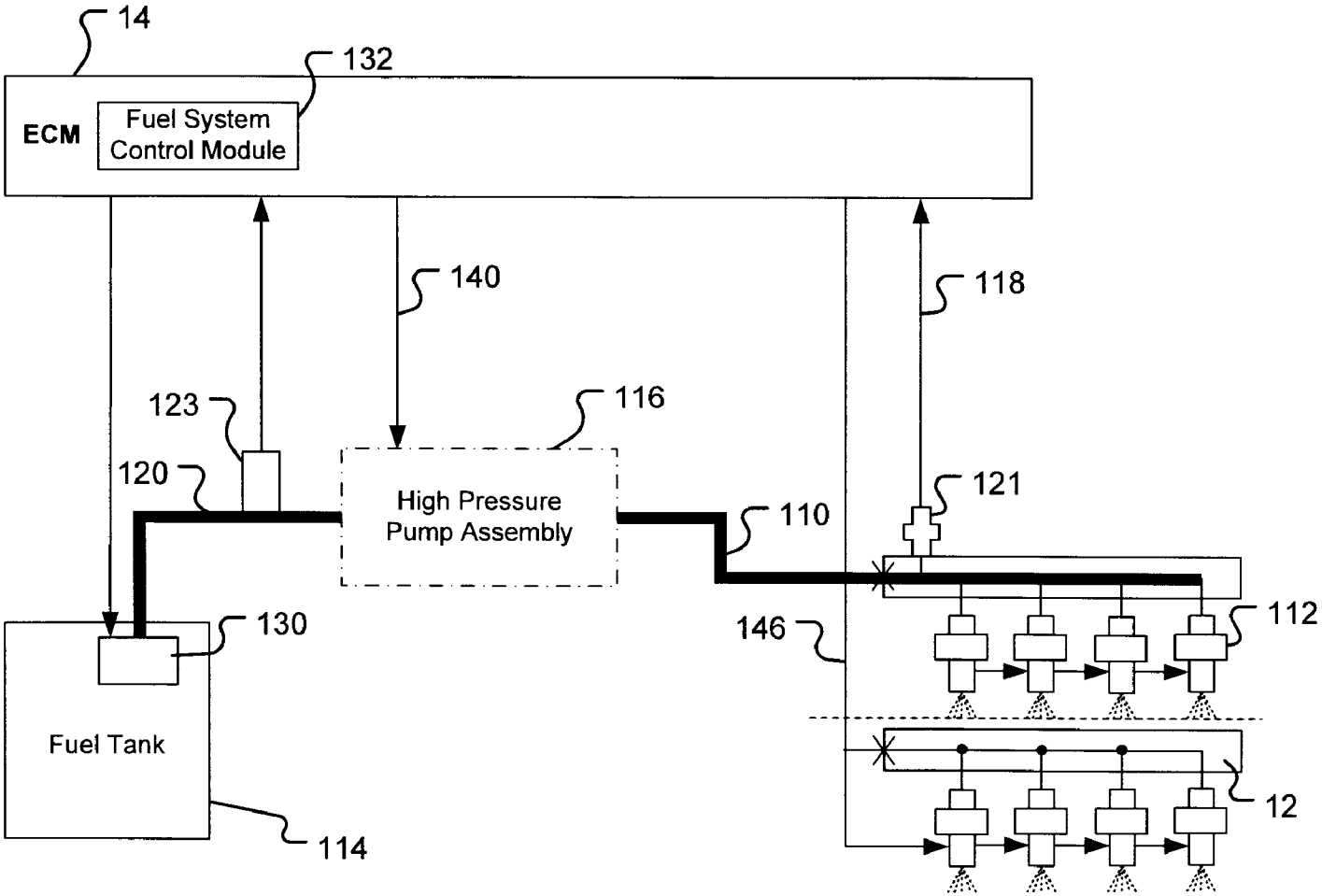
FIG. 2 is a functional block diagram of the fuel system according to the present disclosure.

Referring now to FIG. 2, details of the fuel injection system 16 and the control associated therewith is shown in further detail. A high pressure fuel rail 110 is illustrated having fuel injectors 112 that deliver fuel to cylinders of the engine 12. It should be noted that the fuel rail 110 is illustrated having six fuel injectors 112 corresponding to each of six cylinders of the engine 12 of FIG. 1. More than one fuel rail 110 may be provided on a vehicle. Also, more or fewer fuel injectors may also be provided depending on the configuration of the engine. The fuel rail 110 delivers fuel from a fuel tank 114 through a high-pressure fuel pump 116. The control module 14 controls the high pressure fuel pump 116 in response to various sensor inputs including an input signal 118 from a pressure sensor 121.

The fuel injection system 16 may also include a low-pressure fuel line 120. The pressure of the low-pressure fuel line 120 may be communicated to the ECM from a pressure sensor 123. The low pressure fuel line 120 may be in communication with a primary fuel pump 130 located within the fuel tank 114 of the vehicle. The primary fuel pump 130 may include a fuel system control module 132 located in the ECM 14.

The electronic control module 14 may generate various control signals such as the injector control signal 146 and the high-pressure fuel pump control signal 140.

The high-pressure pump assembly 116 receives low-pressure fuel through the low-pressure fuel line 120 and increases the fuel pressure provided through the high-pressure fuel line 110. The fuel pump 116 may include various types of designs including a design using a cam that turns and moves a pumping member to increase the pressure of the fuel. Of course, various types of pumping assemblies may be used.

Figure 3:
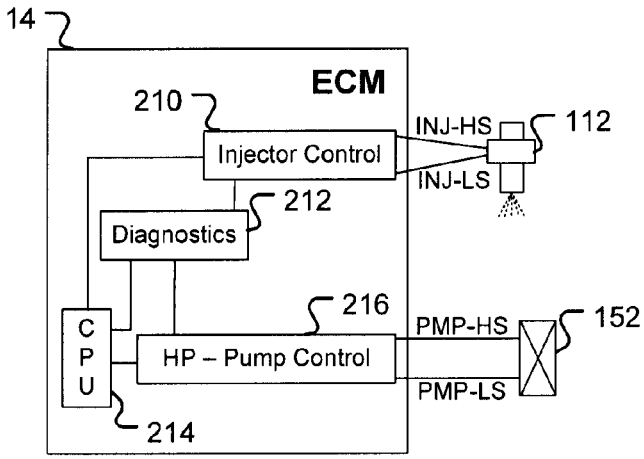
FIG. 3 is a block diagram of the control system of FIG. 1 for performing the method of the present disclosure.

Referring now to FIG. 3, the simplified block diagrammatic view of the electronic control module 14 is illustrated in further detail. The electronic control module 14 may include an injector control module 210 that is used to control the operation of the injectors 112 only one of which is illustrated. The injector control module 210 may perform high side driver control using high side driver control signal INJ-HS. The injector control module 210 may also be a low side driver control module using low side control module signal INJ-LS. The injector control module may also be both high side driver controlled and low side driver controlled simultaneously. Both the high side control signal and the low side control signal may be pulse width modulated.

A diagnostics module 212 may be in communication with an injector control module 210 for diagnosing errors or faults in the injectors 112 or the injector control module 210. Both the injector control module 210 and the diagnostics control module 212 may be controlled by a central processing unit 214. The central processing unit 214 may also control a high pressure pump control module 216.

The high pressure pump control module 216 may be in communication with the solenoid 152 for the high pressure pump. The solenoid 152 turns on and off the high pressure pump. Control signals from the high pressure pump control module 216 may include a high side driver signal PMP-HS or a low side driver control signal PMP-LS. The pump control module 216 may control solenoid 152 using a high side driver, a low side driver or both in a similar manner to that described above with respect to injector control module 210.

Figure 4:
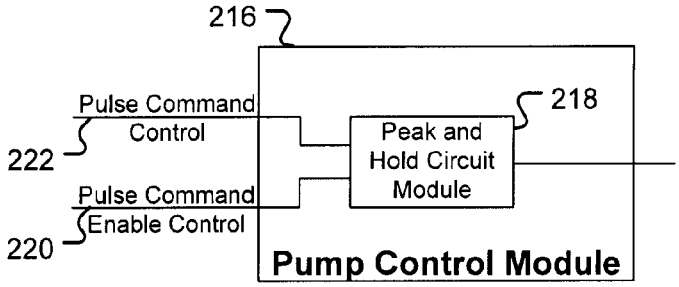
FIG. 4 is a block diagrammatic view of the pump control module of FIG. 3.

Referring now to FIG. 4, the high pressure pump control module 216 may include a peak and hold circuit 218. The peak and hold circuit may have a pulse command enable control signal 220 used to enable pulse width control for the solenoid 152. The pulse command enable control signal enables the pulse command control signal 222 which provides the actual pulse width modulated signal to a solenoid 152 of the high pressure pump 116.

Figure 5:
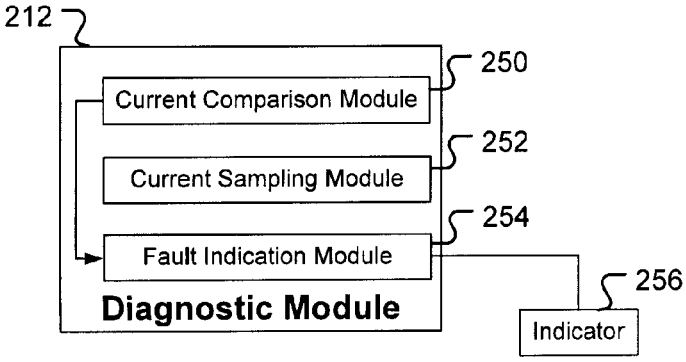
FIG. 5 is a functional block diagrammatic view of the diagnostics module of FIG. 3.

Referring now to FIG. 5, the diagnostics module 212 may include a control current comparison module 250 that is used to control the current in the solenoid with a threshold or plurality of thresholds. In one example, an upper threshold and a lower threshold are set. In order for a fault to be generated the current signal is below the lower threshold or above the upper threshold. A current sampling module 252 is used to generate a sample of the current at a particular time for comparison to the threshold or thresholds. In this case the current is sampled prior to the ending of the pulse command enable signal. This will be described further below.

The diagnostic module 212 may also include a fault indication module 254 that is used to indicate a fault at an indicator 256 should the comparison fall above, below or outside of the threshold set. The indicator 256 may be an audible indicator, a visual indicator or a diagnostics indicator that is provided to a diagnostics system such as OBDII.

Figure 6:
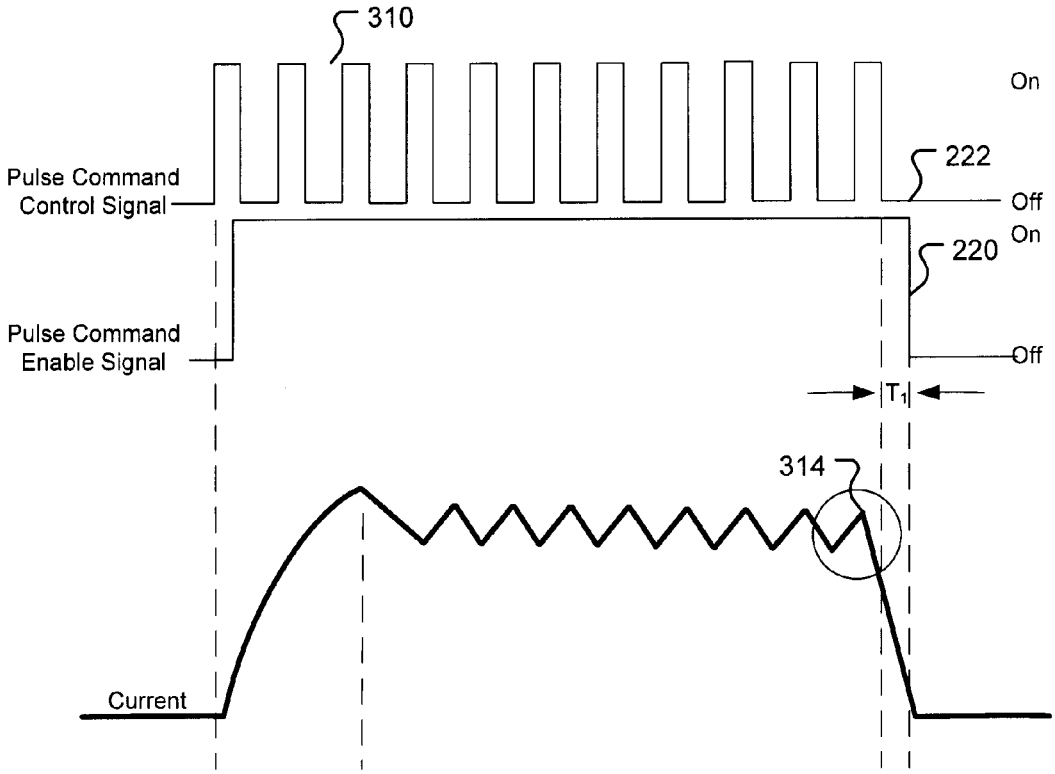
FIG. 6 is a plot of a pulse command control signal, a pulse command enable signal and a current signal according to the present disclosure.

Referring now to FIG. 6, a pulse command control signal 222 that is activated by a pulse command enable signal 220 is illustrated. As can be seen, the pulse command control signal is a pulsewidth modulated signal. At a time $T_1$ prior to the falling edge of the pulse command enable signal 220 a sample is taken of the current signal. The current signal may be a function of both temperature and system voltage. The sample is illustrated as reference numeral 314. The sample could also be taken before the falling edge. The current to be monitored can also be the peak or averaged current. The average current may be taken after a peak during a stable period of operation. The command control signal may be a high side control signal and command enable signal may be a low side control signal.

Figure 7:
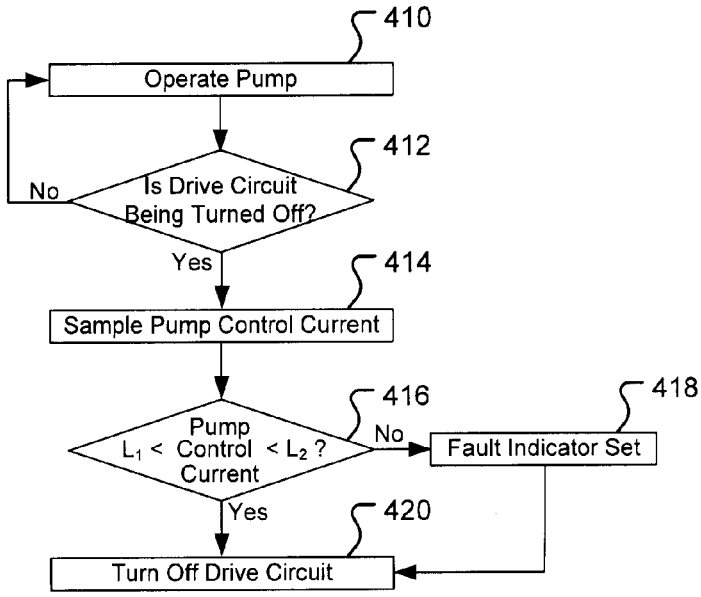
FIG. 7 is a flowchart of a method according to the present disclosure.

Referring now to FIG. 7, a method of operating and diagnosing a pump is illustrated. In step 410, the pump is operated by commanding a pulse command enable signal which is used to activate pulse width modulated control using the pulse command control signal illustrated in FIG. 6. Prior to the falling edge of the pulse command enable signal 220, a sample of the current signal is taken. In step 412, it is determined whether or not the drive circuit is being turned off. The drive circuit being turned off may be determined by using the pulse command enable signal as mentioned above. When the drive circuit is not being turned off, step 410 is again performed. In step 412, if the drive circuit is being turned off such as the end of the pulse command enable signal, a sample of the pump control current signal is taken in step 414. The pump control current is compared to a threshold or thresholds in step 416. If one threshold is used, the pump control current is compared with the threshold and if it is either above or below, depending on the circumstances, a fault indicator is set in step 418. In this case, step 416 determines whether the pump control signal is between a lower threshold $L_1$ and an upper threshold $L_2$. If, in this case, the pump control current is between the thresholds no fault indicator is set in step 418. The thresholds may be a function of pump solenoid resistance, pump solenoid temperature, and/or system voltage. In step 416, if the pump control current is within the thresholds, the drive circuit is turned off normally and no fault indicator is generated in step 420. It should be noted that, because the pump control current is sampled at a time that is consistent in the operation of the pump, reliable results may be obtained when comparing to a threshold. The threshold or thresholds may be obtained experimentally so that an indicator may be provided to a diagnostic system. When the current is too high or too low, a fault may be set and fuel control may go open loop or take any other necessary actions. With the peak and hold circuit, the sample current will have consistent results. After a fault indicator is set, other remedial actions such as a limp-home mode or a power limiting mode take place so that the vehicle may maintain operation. An indicator may, however, be provided to provide an indicator for checking the engine or the like. The indicator may be an IP activated indicator or an audible indicator.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A method of controlling a pump comprising:
communicating a drive signal to the pump;
operating the pump in response to the drive signal;
prior to an end of the drive signal, sampling a pump current signal to form a sample;
comparing the sample to a threshold; and
generating a fault signal in response to comparing.

2. A method as recited in claim 1 wherein after measuring the pump current, ending the drive signal.

3. A method as recited in claim 1 wherein the drive signal enables a pulse control signal.

4. A method as recited in claim 3 wherein the drive signal disables the pulse control signal.

5. A method as recited in claim 1 wherein comparing the sample to a threshold comprises comparing the sample to an upper threshold and a lower threshold and wherein generating the fault signal comprise generating the fault signal when the sample is above the upper threshold or below the lower threshold.

6. A method as recited in claim 5 wherein the upper threshold and the lower threshold are a function of at least one of pump solenoid resistance, pump solenoid temperature, and system voltage.

7. A method as recited in claim 1 further comprising communicating fuel to a fuel rail from the pump.

8. A method as recited in claim 1 further comprising communicating fuel to a direct injection engine from the pump, said pump comprising a high pressure pump.

9. A method as recited in claim 1 further comprising generating a visual indicator in response to the fault signal.

10. A method as recited in claim 1 wherein sampling a pump current comprises sampling the pump current a predetermined time before the end of the drive signal.

11. A method as recited in claim 1 wherein sampling a pump current comprises sampling the pump current a predetermined time before the end of an enable signal.

12. A system for controlling a pump comprising:
a pump control module communicating a drive signal to the pump;
a high pressure pump in communication with the pump control module operating in response to the drive signal;
a current sampling module sampling a pump current signal to form a sample prior to an end of the drive signal;
a current comparison module comparing the sample to a threshold; and
a fault indication module generating a fault signal in response to comparing.

13. A system as recited in claim 12 wherein pump control module ending the drive signal after measuring the pump current.

14. A system as recited in claim 12 wherein the drive signal enables a pulse control signal in communication with the high pressure pump.

15. A system as recited in claim 14 wherein the drive signal disables the pulse control signal.

16. A system as recited in claim 12 wherein the comparison module compares the sample to an upper threshold and a lower threshold and wherein the fault indication module generates the fault signal when the sample is above the upper threshold or below the lower threshold.

17. A system as recited in claim 12 wherein the upper threshold and the lower threshold are a function of at least one of pump solenoid resistance, pump solenoid temperature, and system voltage.

18. A system as recited in claim 12 further comprising a direct injection engine in fluid communication with the pump, said pump comprising high pressure pump.

19. A system as recited in claim 12 wherein the fault indicator module generates a visual warning in response to the fault signal.

20. A system as recited in claim 12 wherein the pump comprises a solenoid, said current sampling module sampling the pump current.

* * * * *